US010258135B2

(12) United States Patent
Leek

(10) Patent No.: US 10,258,135 B2
(45) **Date of Patent: *Apr. 16, 2019**

(54) CAPE WITH DETACHABLE OR CONCEALABLE SLEEVES

(71) Applicant: Leonard Leek, Lansing, MI (US)

(72) Inventor: Leonard Leek, Lansing, MI (US)

( * ) Notice: Subject to any disclaimer, the term of this patent is extended or adjusted under 35 U.S.C. 154(b) by 108 days.

This patent is subject to a terminal disclaimer.

(21) Appl. No.: 15/245,942

(22) Filed: Aug. 24, 2016

(65) Prior Publication Data

US 2017/0258209 A1 Sep. 14, 2017

Related U.S. Application Data

(63) Continuation-in-part of application No. 15/068,082, filed on Mar. 11, 2016, now abandoned.

(51) Int. Cl.

| | |
|---|---|
| ***A45F 4/12*** | (2006.01) |
| ***A41D 3/02*** | (2006.01) |
| ***A41D 3/08*** | (2006.01) |
| ***A41D 15/04*** | (2006.01) |
| ***A41D 27/10*** | (2006.01) |
| ***A44B 1/00*** | (2006.01) |
| ***A41D 27/18*** | (2006.01) |

(52) U.S. Cl.

CPC ..... *A45F 4/12* (2013.01); *A41D 3/02* (2013.01); *A41D 3/08* (2013.01); *A41D 15/04* (2013.01); *A41D 27/10* (2013.01); *A41D 27/18* (2013.01); *A44B 1/00* (2013.01); *A41D 2200/20* (2013.01); *A41D 2300/32* (2013.01); *A41D 2300/322* (2013.01); *A41D 2300/324* (2013.01); *A41D 2300/33* (2013.01)

(58) Field of Classification Search

CPC ..... A45F 4/12
USPC ..... 2/125, 126, 88
See application file for complete search history.

(56) References Cited

U.S. PATENT DOCUMENTS

| | | | | | |
|---|---|---|---|---|---|
| 1,387,937 | A * | 8/1921 | Paull | A41D 3/00 | 2/88 |
| 2,144,875 | A * | 1/1939 | Forrest | A41D 15/00 | 2/88 |
| 2,382,396 | A * | 8/1945 | Carlu | A41D 5/00 | 2/126 |
| 2,452,475 | A * | 10/1948 | Kraft | A41D 3/04 | 2/87 |
| 2,690,565 | A * | 10/1954 | Cornet | A41D 1/04 | 2/103 |
| 2,717,390 | A * | 9/1955 | Houze | A41D 15/00 | 2/105 |
| 2,745,104 | A * | 5/1956 | Pompa | A41D 3/08 | 2/88 |
| 3,154,790 | A * | 11/1964 | Rosenberg | A41D 27/10 | 2/126 |
| 3,380,075 | A * | 4/1968 | Marthinsson | A41D 15/00 | 2/126 |
| 4,006,495 | A * | 2/1977 | Jones | A41D 3/00 | 2/126 |

(Continued)

*Primary Examiner* — Sally Haden
(74) *Attorney, Agent, or Firm* — Butzel Long, PC; Gunther J. Evanina

(57) ABSTRACT

An article configured to cover the torso of a wearer includes reversible sleeves that can either extend outwardly from the garment for covering the arms of a wearer or positioned within the garment, and closures for closing the sleeve openings and concealing the sleeve, and/or detachable sleeves.

18 Claims, 6 Drawing Sheets

(56) References Cited

U.S. PATENT DOCUMENTS 4,389,735 A * 6/1983 McLaughlin ..... A41D 15/04 2/94
4,476,587 A * 10/1984 Itoi ..... A41D 3/005 2/94
4,569,089 A * 2/1986 Nesse ..... A41D 3/00 2/102
4,574,397 A * 3/1986 Dennard ..... A41D 15/04 2/126
4,932,574 A * 6/1990 Doshi ..... A41D 15/04 2/94
5,077,838 A 1/1992 Senser
5,165,111 A 11/1992 Lieberman
5,201,075 A * 4/1993 Svetich ..... A41D 15/00 2/108
5,228,140 A * 7/1993 Baustin ..... A41D 1/00 2/247
5,628,064 A * 5/1997 Chung ..... A41D 15/00 2/119
5,657,489 A * 8/1997 Ponstein ..... A41D 3/08 2/69
6,298,485 B1 * 10/2001 Heller ..... A41D 3/005 2/126
6,360,370 B1 3/2002 Ferreras
6,473,904 B2 * 11/2002 Long ..... B63C 11/04 2/126
8,042,196 B1 10/2011 Kirby
8,245,322 B1 * 8/2012 Bouza ..... A41D 13/0012 2/102
8,690,031 B1 * 4/2014 Blakley ..... A45B 11/02 224/153
2004/0099704 A1 * 5/2004 Zion ..... A45F 3/08 224/576
2005/0056669 A1 * 3/2005 Lavelle ..... A41D 3/08 224/153
2007/0083983 A1 * 4/2007 Barclay ..... A41D 3/00 2/227
2009/0249527 A1 * 10/2009 Hunte ..... A41D 15/04 2/84
2009/0272773 A1 * 11/2009 Andrade ..... A41D 13/0012 224/153
2010/0059558 A1 * 3/2010 Robinson ..... A41D 3/08 224/155
2010/0122395 A1 * 5/2010 Wall ..... A41D 15/04 2/84
2010/0127025 A1 * 5/2010 Kelling ..... A41D 15/04 224/153
2011/0290794 A1 * 12/2011 Lin ..... A45C 7/0077 220/4.22
2012/0047624 A1 * 3/2012 Hubsmith ..... A41D 15/00 2/125
2012/0152772 A1 * 6/2012 Garner ..... A45F 3/005 206/223
2012/0227153 A1 * 9/2012 Laycock ..... A41D 19/0041 2/88
2012/0312850 A1 * 12/2012 Killion ..... A45F 4/12 224/576
2013/0212770 A1 * 8/2013 Lettieri ..... A41D 15/04 2/84
2014/0090147 A1 * 4/2014 Tyler ..... A45F 4/12 2/69
2014/0137308 A1 * 5/2014 Koo ..... A45F 4/12 2/69.5

* cited by examiner

CAPE WITH DETACHABLE OR CONCEALABLE SLEEVES

CROSS-REFERENCE TO RELATED APPLICATIONS

This application is a continuation-in-part of application Ser. No. 15/068,082, filed Mar. 11, 2016, which is incorporated herein by reference in its entirety.

FIELD OF THE DISCLOSURE

This disclosure pertains to capes and robes having sleeves that can be detached or concealed.

BACKGROUND OF THE DISCLOSURE

Various foul-weather clothing systems and robes or capes are known. However, such systems and garments do not offer flexibility in their use and are not adjustable for varying weather conditions.

SUMMARY OF THE DISCLOSURE

Disclosed is a cape or robe configured to cover a torso of a wearer and having sleeves that can extend outwardly through a closure adjacent a shoulder area of the cape or robe, or allowed to be positioned on the inside of the garment and concealed by the closure.

Also disclosed is an article comprising a cape or robe integrally attached to a pouch wearable around a neck of a human wearer that offers the convenience and comfort of a selectively deployable and stowable torso covering that can be worn around the neck without restricting head movement or causing discomfort or visual distraction, and which includes sleeves that can extend outwardly from a closure and be worn over the arms, or disposed within the gown or robe and concealed by the closure.

Also disclosed is a cape or robe having sleeves that are releasably attached, allowing the cape or robe to be worn either with sleeves or as a sleeveless garment.

DETAILED DESCRIPTION

Figure 1:
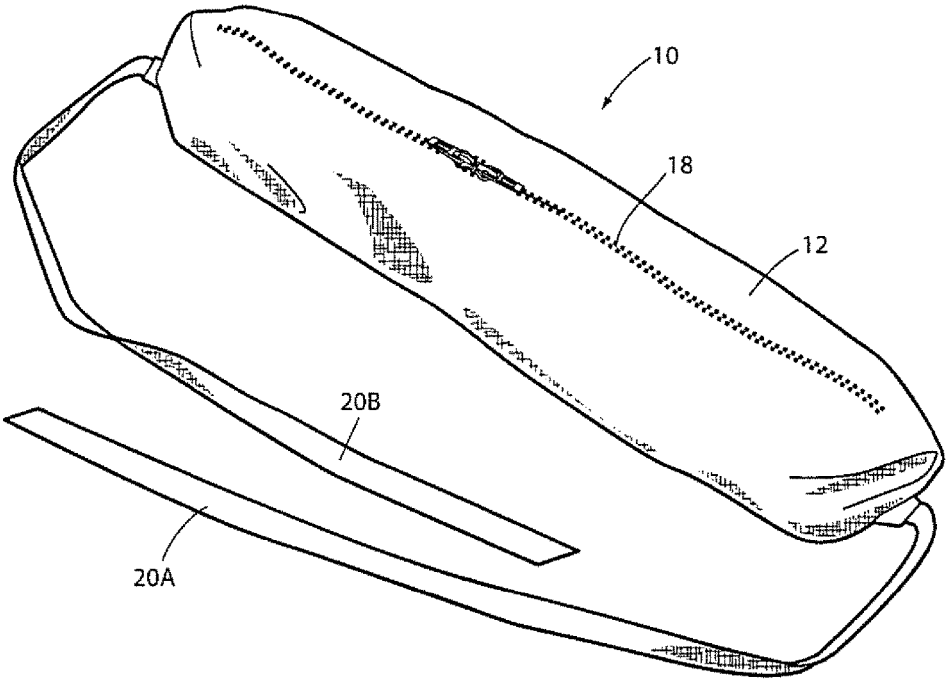
FIG. 1 is a perspective view of the integral pouch and cape or robe articles with the cape or robe contained in the pouch and the pouch zippered closed.
Figure 2:
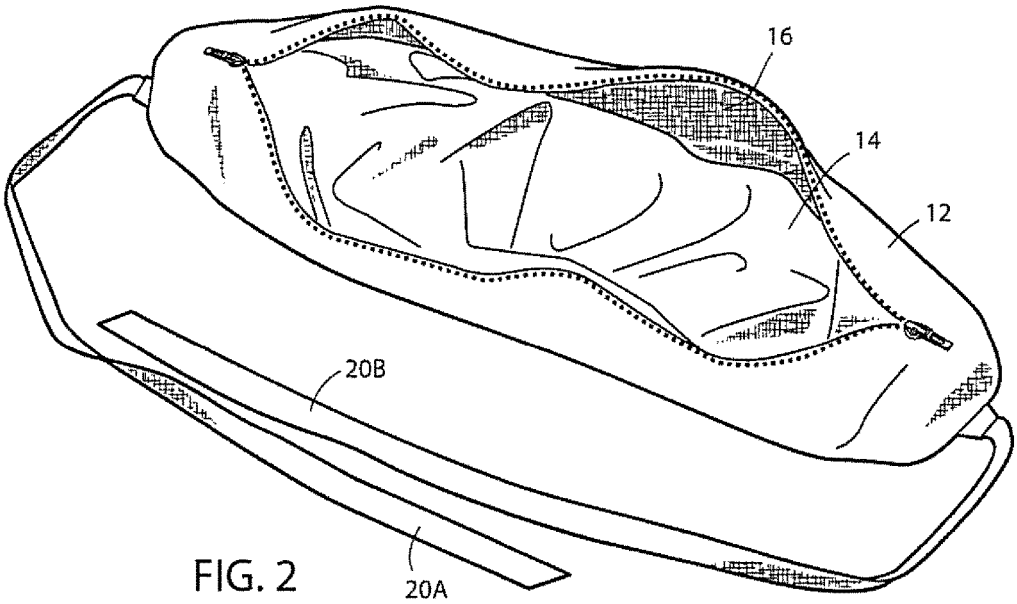
FIG. 2 is a perspective view of the articles shown in FIG. 1 with the pouch zippered open to reveal the cape or robe folded, rolled or otherwise disposed within the pouch.

An article 10 including a cape or robe selectively stowable or deployable from a pouch wearable around a neck of a human wearer is shown in the drawings. Article 10 includes a pouch 12 configured to selectively enclose and deploy a cape or robe 14 (FIGS. 1 and 2). Pouch 12 includes an opening 16 that extends along the length direction of the pouch and that can be selectively opened or closed with a closure element 18, such as a zipper, buttons, snaps or hook and loop fasteners (e.g., fasteners sold under the trademark "Velcro").

The term "cape" encompasses sleeveless garments that drape loosely over the shoulders and cover the torso. Such capes can be of generally any desired length, such as to the waist or lower (e.g., to the knees of the wearer). The term "robe" encompasses loose outer garments that may or may not include sleeves.

Figure 8:
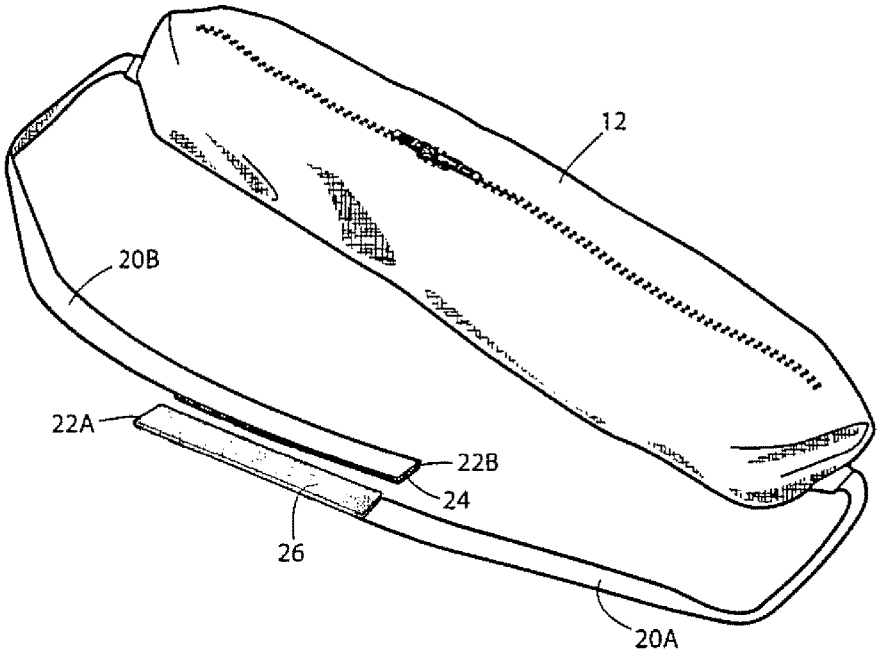
FIG. 8 is a perspective view of an embodiment of the pouch portion of the article in which the distal ends of the straps extending from opposite ends of the pouch are provided with hook and loop type fastening elements.
Figure 9:
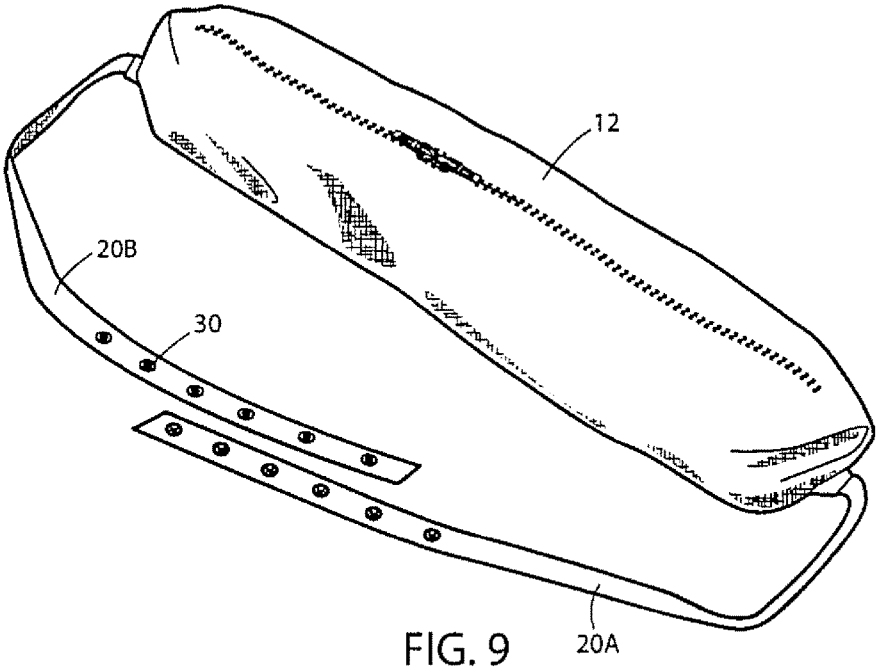
FIG. 9 is a perspective view of another embodiment of the pouch portion of the article in which the distal ends of the straps extending from opposite ends of the pouch are provided with snap-type fasteners.

Straps 20A, 20B have proximal ends attached at opposite ends of pouch 12. Straps 20A and 20B are joinable at their respective distal ends to secure pouch 12 on the neck of a wearer. For example, straps 20A and 20B can be tied together, such as in a bowknot. Alternatively, distal ends 22A and 22B can be provided with fastening elements such as hook 24 and loop 26 fasteners (as shown in FIG. 8), or snap fasteners 30 (as shown in FIG. 9). By employing a plurality of snap fasteners 30, the straps can be adjusted as desired by the wearer for comfort and securement.

Straps 20A and 20B can be made of a fabric that is the same as or different from the fabric used to make pouch 12. Straps 20A and 20B can be integrally cut with the fabric of the pouch or can be sewn to pouch 12.

Figure 3:
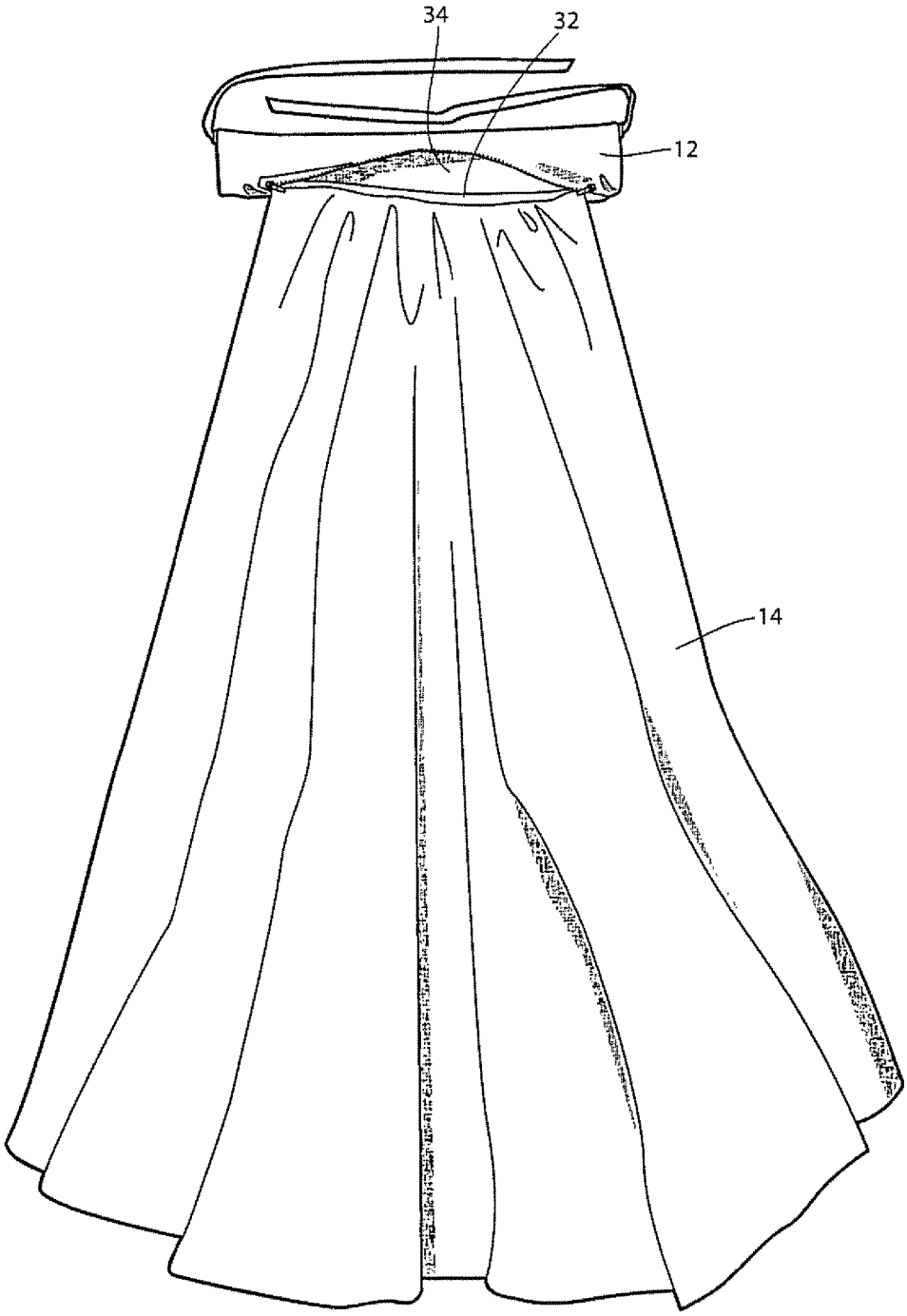
FIG. 3 is a perspective view of the article shown in FIG. 1 with the cape or robe deployed from the pouch.

An upper edge 32 of cape or robe 14 is fastened to an inner section 34 of pouch 12 (FIG. 3). For example, cape or robe 14 can be sewn to pouch 12. Alternatively, cape or robe 14 can be releasably attached to pouch 12, such as with a zipper, snap fasteners or buttons.

Figure 4:
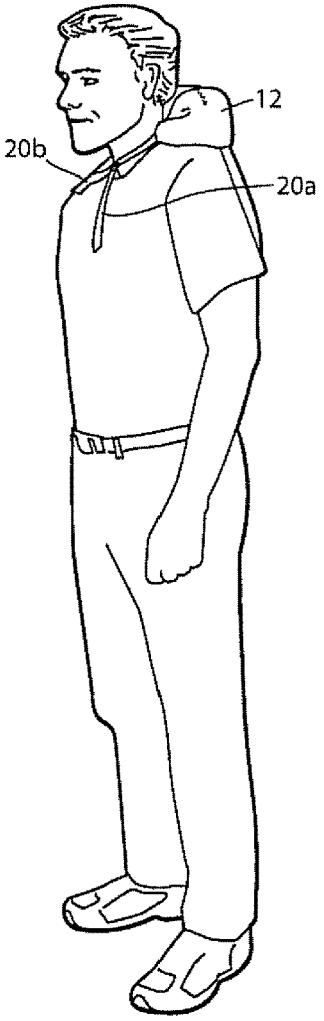
FIG. 4 is a perspective view of the article of FIG. 1 worn on the neck of a human wearer with the cape or robe stowed in the pouch.

As shown in FIG. 4, article 10 can be worn with pouch 12 extending along only the back portion of the neck of the wearer, thereby offering unrestricted movement of the head of the wearer in a forward direction or a sideward direction.

Figure 5:
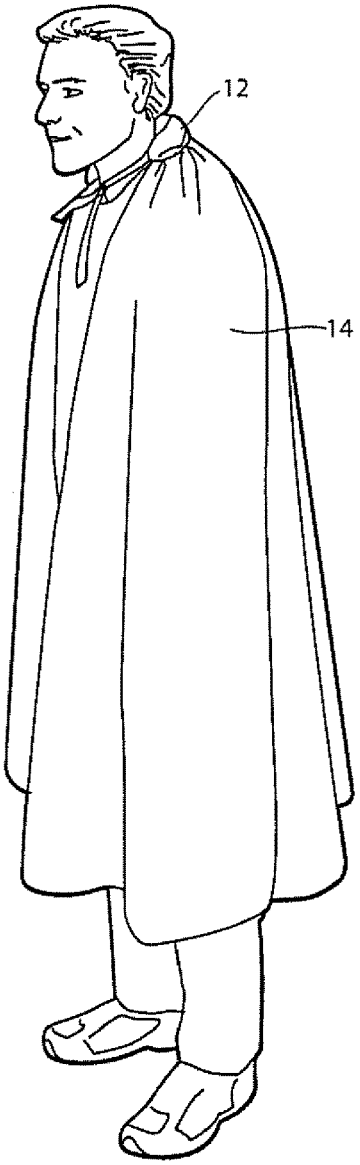
FIG. 5 is a perspective view of the article of FIG. 1 worn on the neck of a human wearer with the cape or robe deployed from the pouch and draped over the shoulders of the wearer and covering the torso of the wearer.

Robe or cape 14 can be easily deployed from pouch 12 without removing article 10 from around the neck of the wearer by releasing closure fastener 18 to open pouch 12 and allow robe or cape 14 to deploy. Cape or robe 14 can then be pulled over the shoulders of the wearer (FIG. 5).

Figure 6:
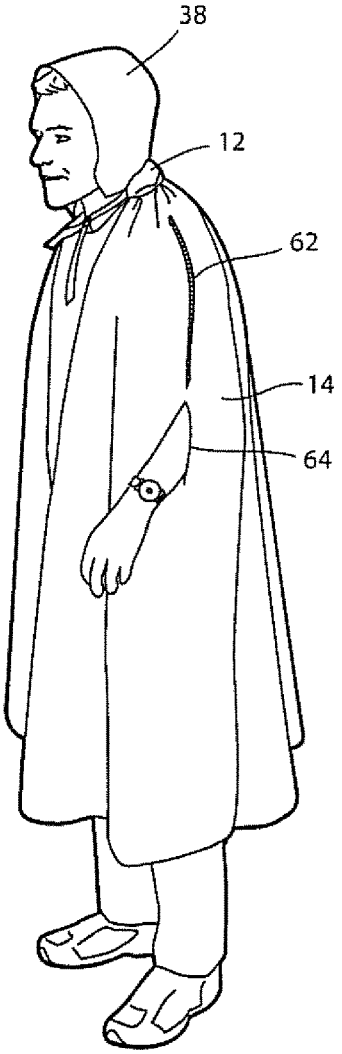
FIG. 6 is a perspective view of an alternative embodiment that includes a selectively stowable and deployable hood, and concealable sleeves.

In certain embodiments, a hood 38 can be provided (FIG. 6). Hood 38 can be attached to an inner section of pouch 12 such as by sewing, or releasably attached such as with a zipper, buttons, snap fasteners, or hook and loop fasteners.

Figure 7:
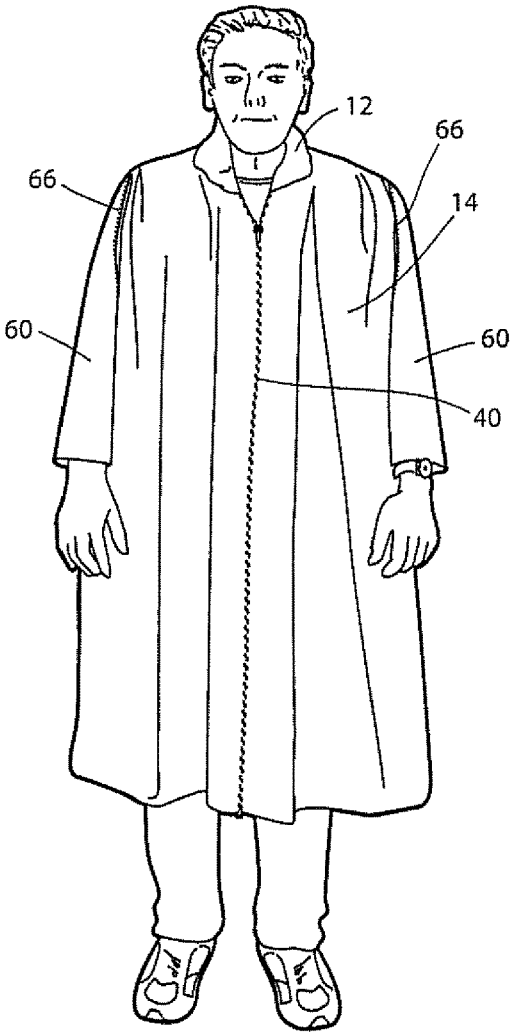
FIG. 7 is a perspective view of another alternative embodiment that includes a front closure, namely a zipper, and includes detachable sleeves.
Figure 10:
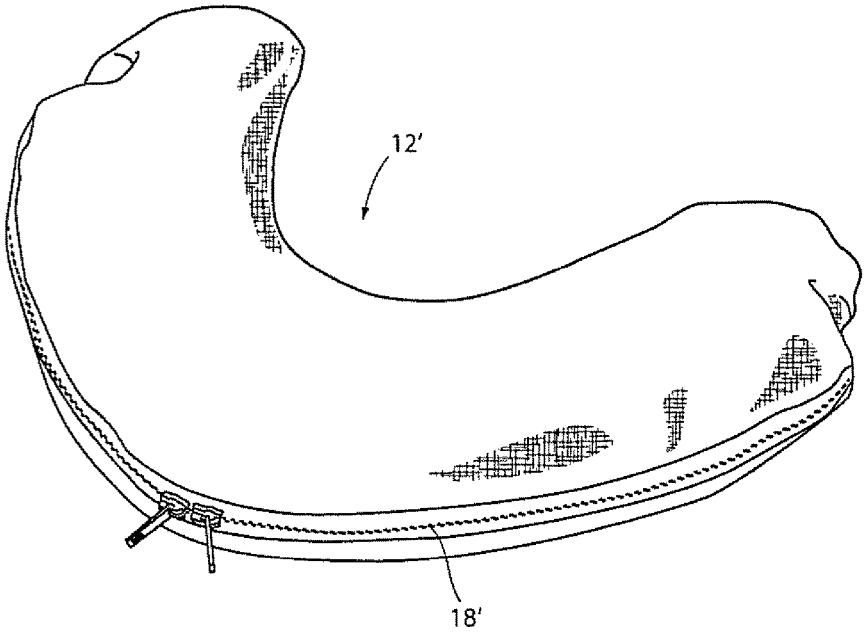
FIG. 10 is a perspective view of another embodiment in which the pouch has a crescent shape.

As shown in FIG. 7, cape or robe 14 can be provided with a front closure 40 such as a zipper. Pouch 12 (FIG. 10) can be configured to resemble a collar of the cape 14 when the cape is deployed. For example, pouch 12' has a crescent shape with a zipper 18' along a front edge thereof. The crescent shape creates the collar-like appearance.

In certain embodiments, the robe or cape 14 can be provided with sleeves 60 that can extend outwardly at the shoulder area and be worn over the arms as shown in FIG. 7 or pulled inwardly (inside-out) so that they can hang loosely or otherwise be situated on the inside of the cape (see FIG. 6). Zippered closures 62 located adjacent the shoulder area of the garment can be provided to conceal sleeves 60 when sleeves 60 are on the inside of the cape or gown. The wearer may extend arms through slits 64 when sleeves 60 are positioned on the inside of the garment.

In certain embodiments, the sleeves can be releasably attached to the garment such as with zippers 66, buttons, hook and loop fasteners, or similar means. This feature can be employed in combination with zippered closures 62, and optionally with slits 64.

Cape or robe 14 can be made of generally any fabric material used for fabricating outerwear. However, to provide a compact lightweight article 10, cape or robe 14 can be made of a lightweight thermally insulative or water-repellant fabric.

The robe or cape 14 can optionally be provided with a removable thermal liner that can, for example, be releasably secured to the cape or robe with a zipper, buttons, Velcro® fasteners (hook and loop), or the like.

While the present invention is described herein with reference to illustrated embodiments, it should be understood that the invention is not limited hereto. Those having ordinary skill in the art and access to the teachings herein will recognize additional modifications and embodiments within the scope thereof. Therefore, the present invention is limited only by the claims attached herein.

What is claimed is:

1. An article comprising a cape or robe integral with a wearable pouch, comprising:

an elongate pouch configured to be worn along a back of a neck of a human wearer, the elongate pouch having first and second opposite ends, an opening extending along a length direction of the elongate pouch between the first and second opposite ends, the opening having a length and a width, the length being parallel with the length direction of the elongate pouch, the length being greater than the width, the opening having a closure for selectively opening and closing the elongate pouch, a first fabric strap having a proximal end attached at the first end of the elongate pouch and a free distal end, a second fabric strap having a proximal end attached at the second end of the elongate pouch and a free distal end, the free distal ends of the first and second fabric straps having fasteners for joining the free distal end of the first fabric strap to the free distal end of the second fabric strap to secure the elongate pouch on the neck of the wearer, the first fabric strap extending laterally from the first end of the elongate pouch and parallel with the length of the opening, and the second fabric strap extending laterally from the second end of the elongate pouch and parallel with the length of the opening, when the fasteners join the free distal end of the first fabric strap to the free distal end of the second fabric strap, the first and second fabric straps extend parallel to the length of the opening;

a cape or robe having shoulders and an upper edge fastened to an inner section of the elongate pouch, the article configured so that the shoulders of the cape or robe are deployable from the elongate pouch over shoulders of the wearer while the first and second fabric straps are joined and extend around the neck of the wearer, the cape or robe is and stowable in the elongate pouch; and a sleeve that can extend outwardly through a sleeve closure adjacent the shoulders of the cape or robe, or can be positioned on the inside of the cape or robe.

2. The article of claim 1, further comprising an arm slit located below the sleeve closure.

3. The article of claim 1, in which the first and second fabric straps and the elongate pouch are made of a fabric material.

4. The article of claim 1, in which the fasteners are selected from the group consisting of snap fasteners and hook and loop fasteners.

5. The article of claim 1, in which the closure is selected from the group consisting of hook and loop closures, snap closures, button closures, and a zipper.

6. The article of claim 1, in which the cape or robe includes a front closure.

7. The article of claim 6, in which the front closure is a zipper.

8. The article of claim 1, further comprising a hood that is selectively stowable in and deployable from the elongate pouch and attached to an upper edge of the cape or robe or to the inner section of the elongate pouch.

9. The article of claim 1, wherein the elongate pouch has a crescent shape.

10. The article of claim 1, wherein the upper edge of the cape or robe is fastened or releasably attached to the inner section of the elongate pouch and said upper edge of the cape or robe extends substantially parallel with the length of the opening.

11. An article comprising a cape or robe integral with a wearable pouch, comprising:

an elongate pouch configured to be worn along a back of a neck of a human wearer, the elongate pouch having first and second opposite ends, an opening extending along a length direction of the elongate pouch between the first and second opposite ends, the opening having a length and a width, the length being parallel with the length direction of the elongate pouch, the length being greater than the width, the opening having a closure for selectively opening and closing the elongate pouch, a first fabric strap having a proximal end attached at the first end of the elongate pouch and a free distal end, a second fabric strap having a proximal end attached at the second end of the elongate pouch and a free distal end, the free distal ends of the first and second straps having fasteners for joining the free distal end of the first fabric strap to the free distal end of the second fabric strap to secure the elongate pouch on the neck of the wearer, the first fabric strap extending laterally from the first end of the elongate pouch and parallel with the length of the opening, and the second fabric strap extending laterally from the second end of the elongate pouch and parallel with the length of the opening, when the fasteners join the free distal end of the first fabric strap to the free distal end of the second fabric strap, the first and second fabric straps extend parallel to the length of the opening; and a cape or robe having shoulders and an upper edge fastened to an inner section of the elongate pouch, the article configured so that the shoulders of the cape or robe are deployable from the elongate pouch over shoulders of the wearer while the first and second fabric straps are joined and extend around the neck of the wearer, and the cape or robe is stowable in the elongate pouch.

12. The article of claim 11, in which the first and second fabric straps and the elongate pouch are made of a same fabric material.

13. The article of claim 11, in which the closure is selected from the group consisting of hook and loop closures, snap closures, button closures, and a zipper.

14. The article of claim 11, in which the cape or robe includes a front closure.

15. The article of claim 14, in which the front closure is a zipper.

16. The article of claim 11, further comprising a hood that is selectively stowable in and deployable from the elongate pouch and attached to the upper edge of the cape or robe or to the inner section of the elongate pouch.

17. The article of claim 11, wherein the elongate pouch has a crescent shape.

18. The article of claim 11, wherein the upper edge of the cape or robe is fastened or releasably attached to the inner section of the elongate pouch and said upper edge of the cape or robe extends substantially parallel with the length of the opening.

* * * * *